United States Patent [19]

Denzler et al.

[11] Patent Number: 4,736,602

[45] Date of Patent: Apr. 12, 1988

[54] WARP KNITTING MACHINE

[75] Inventors: Karl Denzler, Naila; Alfred Böhm, Naila-Holle; Adolf Hägel, Bad Steben; Rudi Wirth, Dobra, all of Fed. Rep. of Germany

[73] Assignee: Liba Maschinenfabrik GmbH, Naila, Fed. Rep. of Germany

[21] Appl. No.: 31,468

[22] PCT Filed: Jul. 3, 1986

[86] PCT No.: PCT/DE86/00277

§ 371 Date: Jan. 27, 1987

§ 102(e) Date: Jan. 27, 1987

[87] PCT Pub. No.: WO87/00216

PCT Pub. Date: Jan. 15, 1987

[30] Foreign Application Priority Data

Jul. 3, 1985 [DE] Fed. Rep. of Germany ..... 3523794

[51] Int. Cl.[4] ..... D04B 27/10

[52] U.S. Cl. ..... 66/210

[58] Field of Search ..... 66/210, 157, 160, 163, 66/209, 211, 212; 139/304; 112/80.44

[56] References Cited

U.S. PATENT DOCUMENTS

| | | | |
|---|---|---|---|
| 2,625,021 | 1/1953 | Schoenster . | |
| 3,762,346 | 10/1973 | Cobble | 112/80.44 |
| 4,387,579 | 6/1983 | Branke et al. | 66/210 |
| 4,628,967 | 12/1986 | Österle | 139/304 |

FOREIGN PATENT DOCUMENTS

| | | |
|---|---|---|
| 2939312 | 4/1981 | Fed. Rep. of Germany . |
| 3025782 | 12/1982 | Fed. Rep. of Germany . |

*Primary Examiner*—Ronald Feldbaum
*Attorney, Agent, or Firm*—Dority & Manning

[57] ABSTRACT

This invention relates to a warp knitting machine in which the knitting elements and each of the warp beams are driven by separate electric motors, powered from a common electrical network. An electric clutch is included in the drive connection between each warp beam and its electric motor and said clutch is energized by the same electric network which powers the electric motors. The electric clutch is energized when electric current is supplied to it by the network and connects the warp beams with their own electric motors. Whenever the electric current in the network is interrupted, the electric clutch is disengaged.

11 Claims, 2 Drawing Sheets

WARP KNITTING MACHINE

BACKGROUND OF THE INVENTION

The invention relates to a warp knitting machine in which the knitting elements and each warp beam are driven by their own electric motors, powered from a common network.

Such a drive for a warp knitting machine is described in German Pat. No. 30 25 782. That patent publication points out that when a power failure occurs in the network, the main shaft of the machine and the parts connected with it come to a standstill only after a certain delay, because of their mass, while the drive of the warp beam or the drives of the warp beams are stopped relatively quickly. This means that all of the warp yarns of all of the warp beams can break. To eliminate this danger, the cited patent publication describes a switching mechanism in which the main shaft of the machine is equipped with an electrically controlled brake which moves from its disengaged position to its braking position under the influence of a stored braking force. This results in the main shaft coming to a stand-still in much less time, almost jerkily, so that breaking of the warp yarns is avoided. Because of the considerable masses involved with the main shaft, this almost jerky braking of the main shaft imparts great stresses upon the machine parts, and this, in turn, can lead to internal shifting in the machine and even to damage. The patent publication also discusses this stressing of the machine, specifically by indicating an additional switch to disengage the above-described brake in case of a normal shut-down process, so that the almost jerky stopping of the main shaft is avoided in this normal procedure. It is, however, impossible to eliminate the stress to the machine which results in case of network power failure.

It should also be noted here that U.S. Pat. No. 2,625,021 discloses an electrically engaged clutch in connection with a warp knitting machine wherein the force which drives the warp beam is derived from the main shaft. Here, the setting of a more or less powerful slaving force via the clutch ensures the maintenance of thread tension at its normal level by imparting more or less powerful driving force to the warp beam when yarn tension is altered.

SUMMARY OF THE INVENTION

It is an object of the instant invention to remove the danger of breakage to which the warp yarns are exposed when a power failure occurs in the network, without subjecting the machine to significant stresses. This is achieved according to the invention by installing an electrically engaged clutch connected to the drive between each warp beam and its electric motor, said clutch being connected to the power network and being engaged by the network current and disengaged when said network current fails.

This clutch is disengaged when a power failure occurs in the network. The interruption of the drive connection between the electric motor and the warp beam eliminates the danger of warp yarns breaking, since the warp beam or beams can continue rotating without difficulty as a result of the traction exerted on them by the knitting elements until said knitting elements are, in turn, stopped when the main shaft stops. In this case, the main shaft can slow down under the effect of its moment of inertia, so that said main shaft and the structural elements to which it is connected are not submitted to any significant stresses. This drive method has been proven through experience to be entirely without danger for the warp yarns because the warp beam is already rotating at this stage of the operation. The friction forces to which it is subjected are always kept as low as possible thanks to its bearing supports, so that the warp yarns still being pulled by the knitting elements can easily rotate the warp beam. This friction can also be entirely desirable, especially if the warp beam is out of balance, since it counters the tendency of said warp beam to continue its rotation because of this imbalance.

Another considerable advantage of interrupting the drive connection between the electric motor and the warp beam resides in the fact that knitting elements, which at first continue to operate when current ceases to flow, automatically bring about the necessary synchronization of the main shaft with the warp beam or beams because of the traction they exert upon the warp yarns and, through them, upon the warp beams, without any special means being required to achieve this. According to the state of the art discussed earlier, this synchronization is hindered in case of the almost jerky stopping of the main shaft, since it must be assumed that the drives of the warp beams stop immediately. For this reason, a preferred embodiment is referred to in German Pat. No. 30 25 782 in which the number of the main shaft's drift revolutions is limited to one or two.

In this manner, the high speed at which the main shaft is braked makes it possible to approach a synchronization of the main shaft with the warp beams, but this is achieved at the cost of subjecting the machine to stress because of the braking speed. By purposely allowing the main shaft to drift in case of a cessation of current flow by providing the further measure of interrupting the drive connection between the electric motor and the warp beam, with the resulting synchronization of the main shaft with the warp beam, the instant invention differentiates itself fundamentally from the principle disclosed in German Pat. No. 30 25 782.

Due to the fact that the warp beam of a warp knitting machine revolves very slowly, a step-down gear is built into the drive connection between the warp beam and its electric motor to adapt the different rotational speeds of the electric motor and motor and warp beam to each other. When an electric motor is now used as a drive at a relatively high speed, the step-down gear can bring about self-locking within the gearing, i.e. the gearing is unable to transmit torque in a direction opposite to the drive direction. This self-locking property prohibits any reverse driving. In such an embodiment, the clutch is installed in the power transmission area, between the warp beam and the self-locking zone. The knitting elements which continue to operate when a power failure occurs in the network continue exerting a pull upon the warp yarns and thereby continue rotating the warp beam without the self-locking feature taking effect, since the clutch separates the warp beam from the self-locking zone if it is disengaged.

Especially when elastic warp yarns are processed, it is possible for these warp yarns to continue exerting such pull upon the warp beam when the knitting elements stop moving that said warp beam continues to rotate for a while, so that the warp yarns finally hang down without tension. The moment of inertia of the warp beam also play a role in this case. Such a dangling of the warp yarns is undesirable because they can become tangled when the warp knitting machine starts up once more. In order to eliminate this danger in advance, it is possible to install a brake in the power transmis zone between the clutch and the warp beam, said brake being set so that in case of power failure the warp beam slows down while tolerable yarn tension is maintained. Since the brake is set to merely maintain a minimum of yarn tension, very little brake action is needed here, and therefore, the brake requires practically no additional energy consumption.

If the energy consumption caused by the brake is undesirable it can be eliminated by allowing the brake to engage only once the clutch has been disengaged.

The clutch can effectively be used as a brake by giving it such spring tension, acting in the direction of engagement, that the clutch acts as a brake when a power failure occurs. When the clutch is engaged under the influence of the network current flow, the brake does not even enter the picture since the clutch ensures power transmission without slippage in that case.

BRIEF DESCRIPTION OF THE DRAWINGS

An embodiment of the invention is represented in the figures, in which.

DETAILED DESCRIPTION OF THE INVENTION

Figure 1:
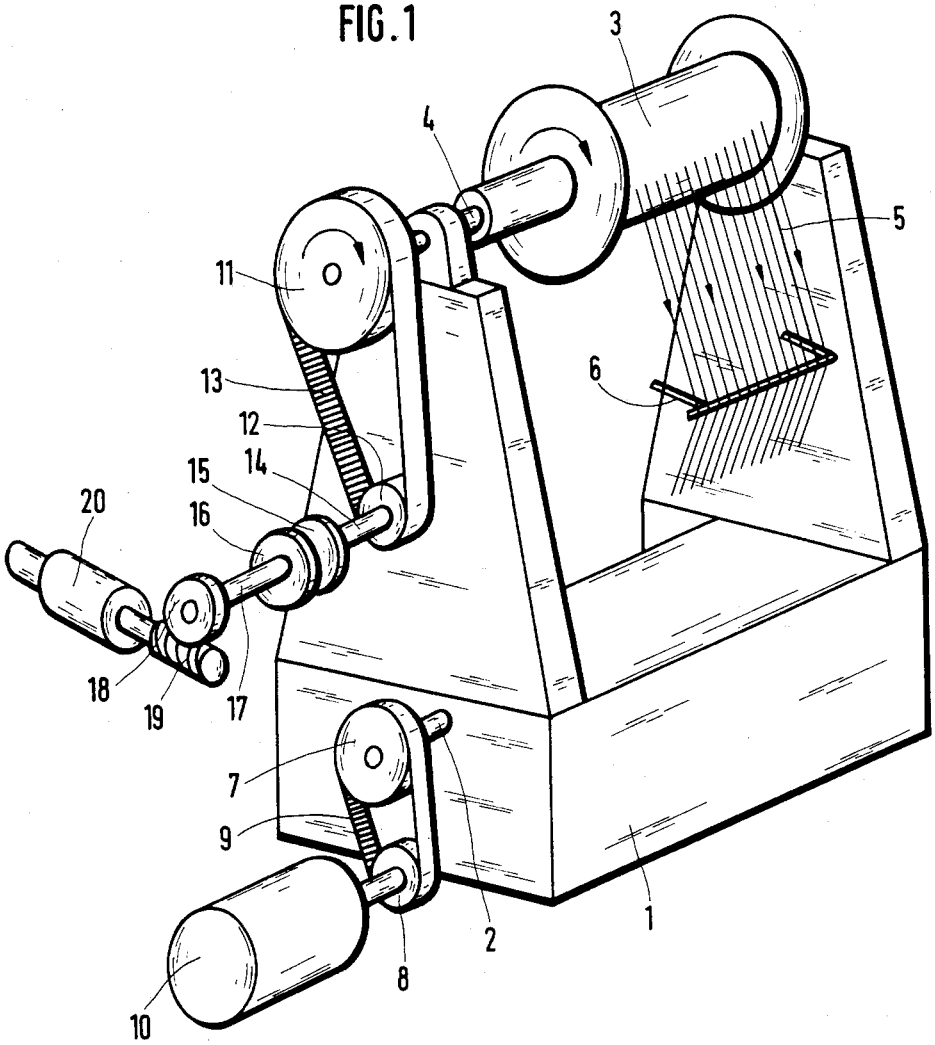
FIG. 1 is a perspective view of the warp knitting machine of the invention, incorporating a warp beam and separate electric motor drives for the main shaft and for the warp beam.

The warp knitting machine shown in FIG. 1 consists of a machine frame 1, traversed by the main shaft 2, which drives the knitting elements (not shown). A warp beam 3 is supported by its axle 4 on the machine frame 1. The warp knitting machine can be equipped with several warp beams in a known manner. The warp yarns 5 are drawn off from the warp beam 3 and are guided to the knitting elements via yarn tensioning bar 6.

The main shaft 2 is driven via the two pulleys 7 and 8 and by the toothed belt 9 which runs around them. Pulley 8 is driven by the electric motor 10 which is the drive ensuring rotation of the main shaft 2.

The warp beam 3 is driven via the two pulleys 12, 11 about which toothed belt 13 runs. Pulley 12 is keyed on shaft 14 which extends into a clutch, represented schematically here by the two clutch disks 15 and 16, which face each other. When the two clutch disks 15 and 16 are pushed together, the clutch is engaged. In FIG. 1, the two clutch disks are shown as being apart to show that the clutch can assume a disengaged position in which said clutch interrupts the drive. The clutch disk 16 is keyed on shaft 17 which supports the worm gear 18. The worm gear 18 engages the endless screw 29, secured to the shaft of the electric motor 20 which is the drive motor of the warp beam 3.

In normal operation, the speeds of the two electric motors 10 and 20 are synchronized with each other through adjustment (in a known manner) so that the speed of the warp beam 3 is adjusted for the amount of warp yarn dictated by the operation of the knitting elements. Both of the electric motors 10 and 20 are connected to the same power network so that both stop in case of power failure. Because of the masses connected with the main shaft 2, the latter continues to rotate for a certain time span, whereby the knitting elements it drives, continue to draw the warp yarns 5 from the warp beam 3.

When current ceases to flow in the network, motor 20 stops earlier than motor 10, in particular because it is not connected with any great gyrating masses rotating at a high speed. To prevent the stopping of motor 20, occurring as it does earlier than the stopping of motor 10, from causing breakage of the warp yarns 5, a clutch consisting of clutch disks 15 and 16 is provided and is also connected to the power network as an electrically activated clutch. The clutch is fashioned so that it is engaged by the flow of network current and therefore disengages when a cessation of current flow occurs. When the current is on, the two clutch disks 15 and 16 are therefore pushed together so as to transfer torque from shaft 17 to shaft 14. In case of cessation of current flow, the clutch is disengaged so that shaft 14, belt pulleys 12 and 11 as well as the warp beam 3 can continue to rotate freely. At the same time, the continued pull exerted by the knitting elements upon the warp yarns 5 causes the warp beam to continue rotating, and to thus act to a certain extent as a reverse drive, slaving the clutch disk 15, thus rotated in relation to the stopped clutch disk 16, via belt pulleys 11 and 12 and toothed belt 13 as it slows down.

Figure 2:
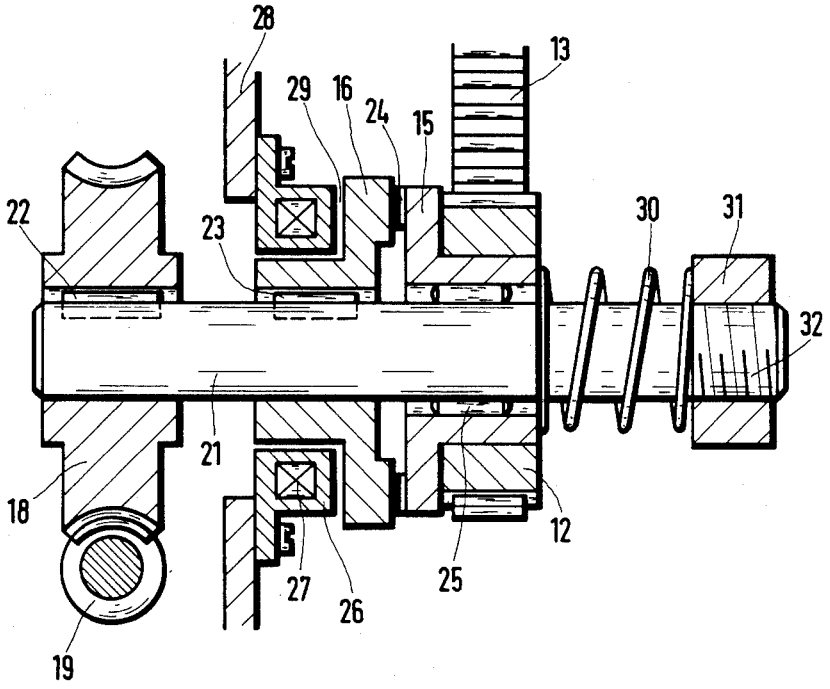
FIG. 2 is a detailed sectional view of the clutch of the invention.

It should be pointed out here that design details of the clutch are shown in FIG. 2, which shall be discussed below.

The disengagement of the clutch consisting of clutch disks 15 and 16 in case of a cessation of current flow, thus makes it possible for the knitting elements, driven by the drifting main shaft 2, to draw off the warp yarns 5 from the warp beam 3 at a slowing pace without breakage of the warp yarns 5, since the pull exerted by said warp yarns 5 upon the warp beam 3 is entirely sufficient to cause its slowly drifting rotation. The required synchronization of the rotation of main shaft 2 with that of the warp beam 3 is obtained automatically by the pull exerted upon the warp yarns and the resulting slaving of warp beam 3, unhindered in its drifting rotation.

FIG. 2 shows an electrically activated clutch which can take the place of the clutch formed by clutch disks 15 and 16 of FIG. 1. According to FIG. 2, the worm gear 18 is keyed on shaft 21 (which corresponds to the shaft 17 of FIG. 1). The worm gear 18 is fixedly and non-slidably attached to shaft 21 by means of key 22. Worm gear 18 engages endless screw 19 which is driven by motor 10 as shown in FIG. 1. Furthermore, clutch disk 16 is seated on shaft 21 and is fixedly and non-slidably attached to shaft 21 by means of key 23. Opposite clutch disk 16 is clutch disk 15 which can be shifted in axial direction and which is equipped with the friction lining 24. When clutch disks 15 and 16 are pushed together with sufficient force, the lining 24 causes their mutual slaving. Clutch disk 15 is supported along shaft 21 on the bearings 25 which impart mobility to the coupling disk 15 in relation to shaft 21 so that the clutch disk 15 can be shifted in the axial direction with respect to the shaft 21 and can also be rotated with respect to said shaft 21. Pulley 12 is keyed on clutch disk 15 in fixed attachment to clutch disk 15 so that when clutch disk 15 rotates the pulley 12 is slaved and thus drives the toothed belt 13 in the manner shown in FIG. 1.

An electric magnet 26 with a magnetizing coil 27 is located within range of clutch disk 16, whereby the electric magnet 26 is held in its position by the bearing plate 28. A gap 29 is provided between the electric magnet 26 and the clutch disk 16 to ensure that free rotation of the clutch disk 16 in relation to electric magnet 26 is possible. This is a known design of an electrically activated clutch. When the magnetizing coil 27 is excited (connection to the power source) the magnetic field it generates pulls the clutch disk 15 against clutch disk 16, causing the clutch to be engaged. This is a process which is also known in electrically activated clutches. In case of cessation of current flow, however, clutch disk 15 is released (the effect of the pressure spring 30 shown in FIG. 2 shall be disregarded for the time being), so that the clutch disk 15 no longer presses against clutch disk 16, whereby the clutch is functionally disengaged. In this operation position, shaft 21 can stop rapidly while clutch disk 15 can rotate freely in relation to shaft 21. The warp beam 3 which drifts in this case and acts as a reverse drive according to FIG. 1, can thus drive pulley 12 and thereby clutch disk 15 in slow rotation until the warp beam 3 has drifted to a stop.

FIG. 2 furthermore shows pressure spring 30 which bears on one side against ring 31 which is fixedly seated on shaft 21 and bears on the other side against clutch disk 15. Pressure spring 30 is adjusted so that it pushes clutch disk 15 against clutch disk 16 with light pressure only. This weak pressure of pressure spring 30 causes weak friction to occur between friction lining 24 and clutch disk 16, acting here as a brake, in case that clutch 16 stops while clutch disk 15 continues to rotate. This friction brakes the rotation of clutch disk 15 so that a driven warp beam 3, which at first continues to rotate, is suitably braked and slowly stops. Prestressing of the pressure spring 30 is adjusted so that the braking action which it provokes does not expose the warp yarns 5 to excessive pull. To adjust the prestressing of the pressure spring 30, it is also possible to install ring 31 over spline 32 so that it is axially adjustable. Depending upon the axial position of ring 31, the degree of presetting of pressure spring 30 and thereby, the force with which a drifting warp beam 3 is braked will be more or less strong. In this design, the function of the clutch is thus combined with the function of the brake by utilizing the same construction elements. The brake therefore prevents the drifting warp beam 3 from "overrunning" the drifting main shaft 2.

In the embodiment shown in FIG. 2, the step-down ratio between endless screw 19 and shaft 21 is so great that the drive element constituted by endless screw 19 and worm gear 18 possesses a self-locking property which prevents rotation of the shaft 21 when the endless screw 19 comes to a stop. The self-locking zone lies in the engagement of worm gear 18 by endless screw 19. If the warp beam 3 could not be freed from the driving force of shaft 21 by such a self-locking effect, this would result, in case of cessation of current flow and continued draw-off of warp yarns 5, in the warp beam 3 being unable to follow this pull so that the warp yarns 5 would break. This breakage is prevented by consisting of clutch disks 15 and 16.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein disclosed.

What is claimed is:

1. A warp knitting machine having knitting elements and a warp beam, comprising:

(a) a first electric motor for driving said knitting elements;

(b) a second electric motor for driving said warp beam in synchronism with said knitting elements;

(c) an electric clutch, interposed between said warp beam and said second electric motor for transmitting drive from said motor to said warp beam when said clutch is energized; and (d) an electric network supplying electric current to said first and second motors and to said clutch whereby said clutch engages to connect said warp beam to said second drive motor as long as said network supplies current to said clutch and disengages said drive connection whenever said current is interrupted, permitting said warp beam to rotate independently of its drive motor.

2. A warp knitting machine as set forth in claim 1, wherein said second drive motor drives said electric clutch through a self-locking beam drive and said clutch is located between said warp beam and said self-locking beam drive.

3. A warp knitting machine as set forth in claim 1, wherein brake means are provided between said clutch and said warp beam and said brake is adjustable to apply a braking force on said warp beam to provide an acceptable degree of yarn tension whenever said current is interrupted.

4. A warp knitting machine as set forth in claim 3, wherein the brake takes effect when said clutch is disengaged.

5. A warp knitting machine as set forth in claim 2, wherein said clutch comprises two disks which are brought into drive engagement upon receipt of electric current and are separated upon interruption of electric current.

6. A warp knitting machine as set forth in claim 5, wherein said clutch disks are urged into braking contact by spring means when the current is interrupted.

7. A warp knitting machine, having knitting elements and a warp beam, comprising:

(a) electric motor means for driving said knitting elements and said warp beam;

(b) an electric clutch connecting said warp beam to said electric motor means, when said clutch is energized; and (c) an electric network for supplying electric current to said motor means and to energize said clutch, whereby said clutch engages to connect said warp beam to said drive motor means as long as said network supplies current to said clutch and disengages said drive connection whenever when current is interrupted, permitting said warp beam to rotate independently of the drive motor means when said current is interrupted.

8. A warp knitting machine as set forth in claim 7, wherein a second drive motor drives said electric clutch through a self-locking beam drive and said clutch is located between said warp beam and said self-locking beam drive.

9. A warp knitting machine as set forth in claim 7, wherein brake means are provided between said clutch and said warp beam and said brake is adjustable to apply a braking force on said warp beam to provide an acceptable degree of yarn tension whenever said current is interrupted.

10. A warp knitting machine as set forth in claim 9, wherein the brake takes effect when said clutch is disengaged.

11. A warp knitting machine as set forth in claim 7, wherein said clutch comprises two members which are urged into braking contact by spring means when the current is interrupted.

* * * * *